US006018636A

United States Patent [19]

Caruthers

[11] Patent Number: 6,018,636

[45] Date of Patent: Jan. 25, 2000

[54] SYSTEM AND METHOD FOR DETECTING AND COMPENSATING FOR CHANGES IN LIQUID XEROGRAPHIC TONER DEVELOPABILITY

[75] Inventor: Edward B. Caruthers, Rochester, N.Y.

[73] Assignee: Xerox Corporation, Stamford, Conn.

[21] Appl. No.: 09/232,463

[22] Filed: Jan. 19, 1999

[51] Int. Cl.[7] ..... G03G 15/10; G03G 15/00; G03G 15/01

[52] U.S. Cl. ..... 399/57; 399/53

[58] Field of Search ..... 399/53, 57, 29, 399/30, 58, 62; 430/30, 45, 117

[56] References Cited

U.S. PATENT DOCUMENTS

| | | | |
|---|---|---|---|
| 5,012,299 | 4/1991 | Sawamura et al. . | |
| 5,240,806 | 8/1993 | Tang et al. . | |
| 5,369,476 | 11/1994 | Bowers et al. . | |
| 5,543,896 | 8/1996 | Mestha . | |
| 5,557,393 | 9/1996 | Goodman et al. . | |
| 5,713,062 | 1/1998 | Goodman et al. . | |
| 5,737,666 | 4/1998 | Lior et al. | 399/57 |

OTHER PUBLICATIONS

G. Gibson et al., "Control of Liquid Electropheretic Toner Supplies", IS&Ts NIP 14: International Conference on Digital Printing Technologies, Toronto, Canada, Oct. 18–23, 1998, pp. 214–217.

*Primary Examiner*—John Pendegrass
*Attorney, Agent, or Firm*—Oliff & Berridge, PLC

[57] ABSTRACT

Changes in toner developability of toners in a liquid toner system are determined and compensated for by sensing the toner concentration and liquid toner volume in a tank, based on changes in the toner concentration and toner mass in the tank. Based on the foreground areas for a color separation layer corresponding to a particular toner, the developed area for that toner for one or more printed pages can be determined. From the developed area and the consumed mass of toner, a developed mass per unit area (DMA) can be determined. Based on the determined DMA, the sensed toner concentration and a voltage differential, the developability of the toner can be determined. Based on a target DMA, the sensed toner concentration and the determined developability of the toner, a new voltage differential can be determined. If the new voltage differential is within a determined range, a target toner concentration is updated based on the target DMA, the determined developability and a target voltage differential for that toner. Based on the updated target toner concentration, toner and/or liquid carrier material can be added to the tank for that toner to change the sensed toner concentration to the updated target toner concentration. In multi-component toners, this method is used to determine the developability of each component. Based on the developability and target DMA of each component of a multi-component toner, new target concentrations of each toner component are determined. Accordingly, the developability of single- and multi-component toner can be corrected for.

40 Claims, 8 Drawing Sheets

SYSTEM AND METHOD FOR DETECTING AND COMPENSATING FOR CHANGES IN LIQUID XEROGRAPHIC TONER DEVELOPABILITY

BACKGROUND OF THE INVENTION

1. Field of Invention

This invention is related to liquid electrophoretic development of latent electrostatic images. More particularly, this invention is directed to systems and methods for measuring and for correcting for changes in the developability of liquid toner color components.

2. Description of Related Art

In liquid electrophoretic image forming systems, liquid developer materials include a liquid carrier material and charged toner particles dispersed into the liquid carrier material. The liquid developer material is applied to a photoreceptor or a dielectric member carrying a latent electrostatic image. The toner particles suspended in the liquid carrier material are attracted toward the image areas of the latent electrostatic image on the photoreceptor or the dielectric member to form a developed liquid image. The developed image on the photoreceptor or the dielectric member may be subsequently transferred either directly to a substrate or to an intermediate transfer member for later transfer to the substrate.

Liquid toner particles include colored material, such as pigments and/or dyes, and/or resin. An additive, called a charge director, may be dissolved in the carrier liquid to impart a charge to the toner particles. An additive, called a charge control agent, may be included in the toner particles to control the charge on the toner particles. Other additives may also be included in the liquid toner to improve its performance.

Liquid electrophoretic toners have been used in various ways in a number of conventional devices. The Xerox ColorgrafX 8954 and similar devices develop the liquid toner onto an electrostatic image written onto a dielectric paper. The Savin 870 printer develops a single color toner onto an electrostatic image on a photoconductor drum. The developed image is then transferred to a final substrate. The AM Graphic Electropress develops two differently-colored toner images onto two photoconductor drums and sequentially transfers the differently-colored toner images to a final substrate. The Indigo E-Print 1000 develops four process color (cyan, magenta, yellow, and black) images onto a photoconductor drum, transfers the four differently-colored toner images to an intermediate member, and then transfers the images from the intermediate member to the final substrate.

Liquid toners have many advantages over powder toners and often produce images of higher quality than images formed with powder toners. For example, images developed with liquid toner may adhere to the copy substrate without requiring fixing or fusing of the image to the copy substrate. In addition, the toner particles suspended in the liquid carrier material can be made significantly smaller than the toner particles used in powder toners. Using such small toner particles is particularly advantageous in multicolor processes where multiple layers of toner particles generate the final multicolor output image. Additionally, multicolor output images made with liquid toners generally have a significantly more uniform finish compared to images formed using powder toners.

Liquid toners typically contain about 0.5–10% by weight of fine solid particulate toner material dispersed in the liquid carrier material. The liquid carrier material is typically a hydrocarbon. After developing the latent electrostatic image, the developed image on the photoreceptor or the dielectric member may contain about 10–20% by weight of the solid particulate toner suspended in a residual layer of the liquid hydrocarbon carrier. To complete the development process, the excess liquid carrier material is typically removed from the photoreceptor or the dielectric member.

Mixing multiple color toners to produce a particular color developing material, in analogy to processes used to produce customer selectable color paints and inks, has generally been extended to electrostatographic printing technology, as disclosed, for example, in commonly assigned U.S. Pat. No. 5,557,393. This mixing includes forming an electrostatic latent image on an image forming device. The electrostatic latent image is then developed on the image forming device with at least one dry powder developer containing carrier particles and a blend of two of more compatible toner compositions. The developed toner image is then transferred to and fixed to a receiving substrate. Among the compatible toner compositions that may be selected are toner compositions having blend compatibility components coated on an external surface of the toner particles or particulate toner compositions containing blend compatibility components or passivated pigments. Electrostatographic imaging devices, including a tri-level imaging device and a hybrid scavengeless development imaging device, can also be used to create multi-color images using this process U.S. Pat. No. 5,713,062 discloses systems and methods for controlling color mixing in an electrostatographic printing system. In the 062 patent, an operative mixture of a colored developing material is continuously replenished with selectively variable amounts of the developing materials of the basic color components that make up the operative mixture. The rate of replenishing the various color components added to the operative mixture is controlled to provide a mixture of developing material capable of producing a customer-selectable color on an output copy substrate. A colorimeter is provided to monitor the color of a test image printed with the operative mixture of the developing material, so that the color of the operative mixture can be brought into agreement with a color required to produce the customer-selectable output color.

U.S. Pat. No. 5,012,299 discloses a color adjustment apparatus for an electrostatographic printing machine. The color adjustment apparatus includes a color chart that visually represents all real colors in terms of color elements of saturation and hue, which can be selected using a touch key. The selected colors can be used to create highlight or spot colors on a printed image. The selected colors are obtained by combining halftones of different primary color separations on a photoreceptor or an intermediate drum. That is, to obtain selected colors by combining primary colored toners, the differently-colored toners are sequentially printed onto a surface, rather than being combined as materials before developing and printing as a solid layer. For the reasons described above, such process color approximations to a customer-selected color will show greater solid area color variations and greater line raggedness. Furthermore, some customer-selected colors can not be as precisely matched by overlapping halftones as by printing a solid area using a mixture of primary colors.

U.S. Pat. No. 5,543,896 discloses methods for measuring tone reproduction curves using a single structured patch. Development control is provided by storing a reference tone reproduction curve. A single test pattern, including a scale of pixel values, is formed in an interdocument zone on a photoreceptor surface. The test pattern is sensed in the interdocument zone. A control response to sensing the test pattern is provided relative to the tone reproduction curve to adjust the print quality.

U.S. Pat. No. 5,369,476 discloses toner control systems and methods for electrographic printing. In the 476 patent, toner is delivered from a reservoir to a toner fountain and applied to an electrostatically charged sheet to form an image. The visual quality of the image is monitored. Toner concentrate is added to the toner in response to the monitored quality to increase the amount of pigment particles in the toner, to maintain a substantially constant image quality. As disclosed in the 476 patent, a test image is formed outside the main image on the sheet. The brightness of one or more predetermined colors in the test image is monitored.

Conventionally, print engines using liquid electrophoretic toners attempt to keep constant the developability of the toner by measuring and keeping constant the volume of the toner, the concentration of the toner particles in the toner and/or the conductivity of the toner. The concentration of the toner particles in the toner is the mass of the toner particles divided by the total mass of the toner, including the mass of the carrier liquid. Methods for measuring these properties and adding one or more toner components in response to changes in measured property values are known as toner replenishment methods. Toner replenishment methods are described in "Control of Liquid Electrophoretic Toner Supplies," by Gibson et al., pp. 214–217, IS&T's NIP 14: International Conference on Digital Printing Technologies, Toronto, Canada, Oct. 18–23, 1998 (Gibson) which is incorporated herein by reference in its entirety.

U.S. patent application Ser. No. 08/721,419 discloses mixing liquid inks to match a customer-selected color, including measuring the transmission spectrum of the mixed ink, using the known absorption spectra of the primary inks which form the mixed ink, determining the concentrations of the primary inks in the mixed ink, and adding primary ink concentrates as needed to keep the primary ink concentrations at the target values appropriate to the customer-selected color.

U.S. patent application Ser. No. 09/093,703 discloses mixing liquid inks to match a customer-selected color, including measuring light transmitted through the mixed ink and each of several optical filters, use of a priori information about the primary inks, determining the primary ink concentrations, and adding primary ink concentrates as needed to keep the primary ink concentrations at the target values appropriate to the customer-selected color.

U.S. Pat. No. 5,240,806 discloses a liquid color toner composition usable with both contact electrostatic transfer processes and gap electrostatic transfer processes. The liquid toner comprises a colored predispersion including a non-polymeric resin material having certain insolubility (and non-swellability), melting point and acid number characteristics, an alkoxylated alcohol having certain insolubility (and non-swellability) and melting point characteristics, and a colorant material having certain particle size characteristics. The liquid color toner further comprises an aliphatic hydrocarbon liquid carrier having certain conductivity, dielectric constant, and flash point characteristics.

U.S. patent application Ser. No. 08/831,454 discloses controlling the composition of a mixed ink by measuring the color of a printed patch and by applying rules for adjusting primary color concentrations based on differences between the printed patch and a customer-selected color.

There are a number of known control systems for controlling electrostatographic processing parameters in response to the quality of the produced image using a test image or patch. For example, it is common to provide a scanning device to sense the optical density or other characteristics of a development test patch to generate a control signal to adjust the print quality.

SUMMARY OF THE INVENTION

The developability of the liquid toner is the ability of the liquid toner to fully develop the electrostatic image on the photoreceptor to a desired image density.

To maintain color quality, from print to print within a single print job, from one print job to another job, and/or from a print job on one printer to the same job printed on another printer of the same kind, requires that the same input color signal always be printed as the same color. To maintain color quality in a printer using a liquid toner requires that the liquid toner's developability be held constant. Alternatively, changes in the liquid toner's developability must be compensated by changing some other part of the printing process.

It is particularly important to maintain constant the relative toner developability of the different toner colors in a multicolor image forming apparatus. For toners which contain only a single color of toner particle, constant color output may be maintained by keeping constant the developed mass of toner per unit area (DMA or $M_D$). The developed mass per unit area is determined by periodically developing solid area test patches of a known area on the photoreceptor. These developed solid area test patches are then sensed to determine the toner mass density within the developed solid area test patch. If a decrease in the liquid toner's developability results in a decrease in the developed mass per unit area, then the surface voltage on the photoconductor or the dielectric member may be increased to increase development.

However, this process requires both an extra sensor to sense the toner mass density of the developed solid area test patches, as well as the ability to print non-image information. Furthermore, if the test patches are not subsequently transferred to an image bearing member, such as the final substrate, the test patches represent an undesirable load on the cleaning system of the print engine.

Changes in the toner particles' charge to mass ratio (q/M) or mobility ($\mu$) results in changes in the particle's developability. Such changes in charge to mass ratio and/or mobility can result from changes in environmental factors, such as, for example, the ambient temperature, the ambient humidity and the like, from the selective development of some toner components, from contamination of one toner supply by toner particles of another toner supply in a multicolor liquid toner image output terminal, and even from batch-to-batch changes in the exact composition of the toner particles of a particular color of toner. As described in Gibson, even if the toner conductivity and the toner solids concentrations can be maintained at desired levels, the developability of the liquid toner may change.

Moreover, when printing custom colors, such as those specified by the Pantone® Color Matching System, the individual toners themselves are formed by a mixture of two or more primary-colored toners. The different primary-colored toners will not necessarily have the same developability response to environmental factors. Thus, even if the total developed mass per unit area is sensed using developed solid area test patches, the test patches will include varying amounts of the two different primary-colored toners. Accordingly, if the relative developability of the constituent primary-colored toners changes, the color of the developed solid area test patch will nevertheless remain undetected. Accordingly, to fully measure such custom colors using developed solid area test patches on the photoreceptor or the dielectric member, a new, more expensive, spectroscopic sensor would be required.

This invention provides systems and methods for measuring liquid toner developability without needing to print or sense test patches on the photoreceptor.

This invention separately provides systems and methods for detecting and compensating for changes in the liquid toner developability.

This invention separately provides for systems and methods that detect changes in the toner developability based at least on changes in the toner solids concentration of the liquid toner.

This invention separately provides for systems that detect and compensate for changes in the relative developabilities of two or more components of mixed, or custom color, liquid electrophoretic toners.

This invention separately provides for systems and methods that measure a developed mass per unit area of the toner.

This invention separately provides systems and methods that control the developability of each of several different toner components of a multi-component toner.

This invention further provides systems and methods that control the proportions of the different toner components in the multi-component toner to match a customer-selected color.

This invention separately provides systems and methods that maintain a specified ratio of toner components in a multi-component toner over long print runs.

According to the systems and methods of this invention, liquid electrophoretic toner image output terminals include at least a toner volume sensor and a toner solids concentration sensor, and may include a toner conductivity sensor. The toner volume sensor senses a volume $V_T$ of the liquid toner in a liquid supply tank. The toner conductivity sensor senses a conductivity $\sigma_T$ of the liquid toner. The toner solids concentration sensor senses a concentration $T_C$ of the toner particles in the liquid toner.

These sensors are connected to a controller that generates and outputs a control signal to a liquid toner supply system that adds toner particles, liquid carrier material and/or charge director to maintain the liquid toner volume, the toner conductivity, and the toner solids concentrations at desired levels.

According to one exemplary embodiment of the systems according to this invention, the image output terminal includes a toner concentration sensor and a liquid toner volume sensor connected between a liquid toner supply system and a controller. The controller is also connected to an image data source and a marking engine. The controller controls the liquid toner supply system and the marking engine based on the sensed toner concentration, the sensed liquid toner volume and the image data, as well as the desired developed mass per unit area and target voltage values for the marking engine.

According to one exemplary embodiment of the methods according to this invention, for each different color toner or each different color component of a mixed toner, the current toner concentration and the current liquid toner volume are measured. A developed area is determined from the image data input from the image data source. Based on the current and previous toner concentration and liquid toner volume measurements, a developed mass of toner value is determined, while, based on the image data, a total developed area is determined. Then, based on the total developed mass of toner and the total developed area, a developed mass per unit area value is determined. Then, based on the determined mass per unit area, the sensed toner concentration and the voltage levels supplied to the marking engine, the developability of the toner is determined.

In other exemplary embodiments of the methods according to this invention, once the developed mass per unit area is determined, one or more voltage levels supplied to the marking engine are adjusted to keep the developed mass per unit area as close as possible to a desired developed mass per unit area value. Similarly, the toner concentration is adjusted to keep the voltage levels supplied to the marking engine near desired levels.

In other exemplary embodiments of the methods according to this invention, once the developed masses per unit area (DMAs) are determined for all components of a mixed liquid toner, the concentrations of the components of the mixed liquid toner are adjusted to bring the DMAs into agreement with the target values needed to supply the target color.

In other exemplary embodiments of the methods according to this invention, a decrease in the relative developability of one component of a mixed liquid toner is compensated by increasing the relative concentration of that component of the mixed liquid toner.

The systems and methods of this invention control the developability of liquid electrophoretic toners, and can be used in the various image forming systems disclosed in the various patents and applications discussed above. The systems and methods of this invention also control the developabilities of several different components of a mixed ink, where the proportions of the components of the mixed ink are chosen to match a customer-selected color. The systems and methods of this invention control the color of an operational mixture of developing material in a toner supply device by continuously monitoring and adjusting the proportions of different toner components forming the operational mixture to maintain a specified ratio of the toner components in the toner supply device over extended periods of time associated with very long print runs. The systems and methods of this invention may also be used to mix a customer-selectable color in situ.

These and other features and advantages of this invention are described in or are apparent from the following detailed description of the preferred embodiments.

BRIEF DESCRIPTION OF THE DRAWINGS

The preferred embodiments of this invention will be described in detail, with reference to the following figures, wherein.

DETAILED DESCRIPTION OF PREFERRED EMBODIMENTS

Figure 1:
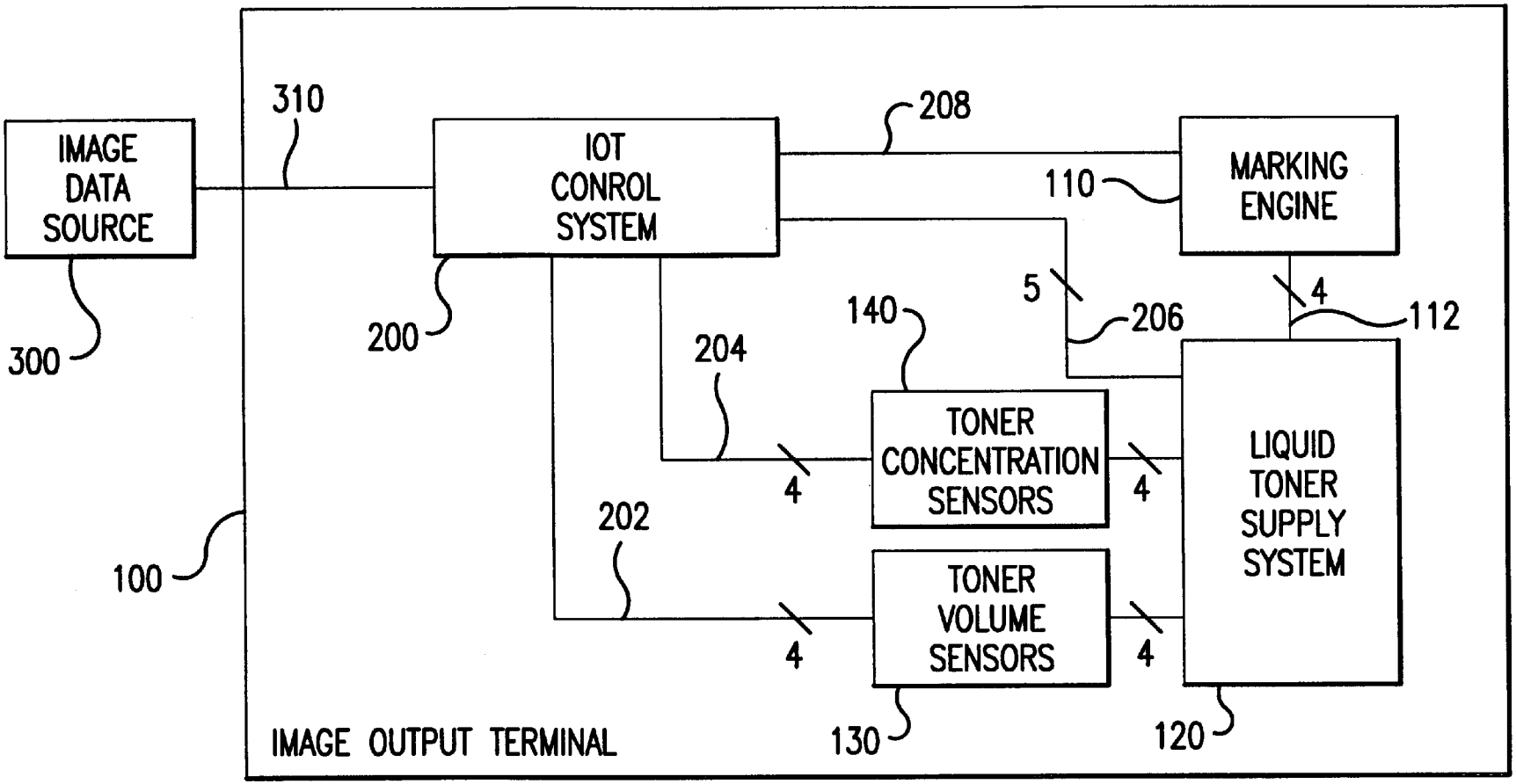
FIG. 1 is a block diagram of one exemplary embodiment of a liquid toner image output terminal according to this invention.

FIG. 1 shows one exemplary embodiment of an image output terminal (IOT) 100 implementing the systems and methods for detecting and compensating for changes in liquid electrophoretic toner developability according to this invention. As shown in FIG. 1, the image output terminal 100 includes a liquid electrophoretic toner marking engine 110, a liquid toner supply system 120, one or more toner volume sensors 130, one or more toner concentration sensors 140 and an IOT control system 200. The IOT control system 200 is connected by a data line 310 to an image data source 300. The image data source 300 can be a personal computer, a scanner, a digital camera, a facsimile machine, a digital copier or any other known or later developed device for generating monochrome or color image data.

When the image data source 300 is a personal computer, the data line 300 connecting the image data source 300 to the image output terminal 100 can be a direct link between the personal computer and the image output terminal 100. The signal line 310 can also be a local area network, a wide area network, the Internet, an intranet, or any other distributed processing and storage network. Moreover, the data line 310 can also be a wireless link to the image data source 300. Accordingly, it should be appreciated that the image data source 300 can be connected using any known or later developed system that is capable of transmitting data from the image data source 300 to the image output terminal 100.

The image output terminal control system 200 receives outputs from the one or more toner volume sensors 130 over one or more signal lines, such as a corresponding number of signal lines, 202. The IOT control system 200 also receives signals from the one or more toner concentration sensors 140 over one or more signal lines, such as a corresponding number of signal lines, 204. The IOT control system 200 provides control signals to the liquid toner supply system 120 over one or more control signal lines 206. The IOT control system 200 also provides control signals and data signals to the marking engine 110 over one or more signal lines 208. Finally, the liquid toner supply system 120 supplies liquid toner to the development stations of the marking engine 110 over a number of liquid toner supply conduits 112.

The image output terminal 110 can be implemented using a number of different liquid toner supply systems 120. These liquid toner supply systems 120 can include a monochrome toner supply system, a three-color or four-color single-component-toner liquid toner supply system, or a multicolor, multi-component-toner custom-color, mixed color liquid toner supply system, such as a Pantone® system. When the liquid toner supply system 120 of the image output terminal 100 is a monochrome toner supply system, there will be one toner concentration sensor 140 and one toner volume sensor 130, and a single toner supply device and a liquid carrier material supply device. Accordingly, there will be one signal line 202, one signal line 204 and two signal lines 206.

Figure 2:
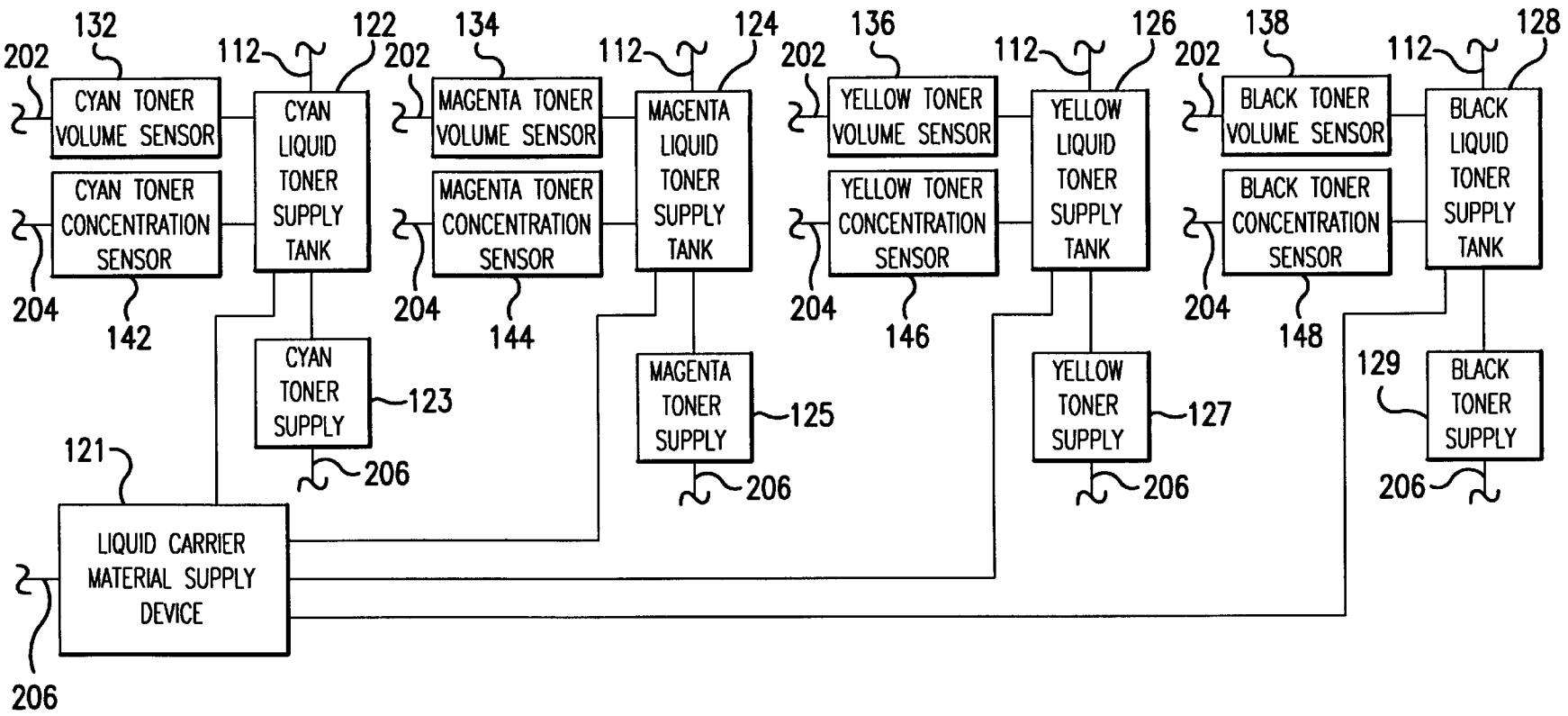
FIG. 2 shows in greater detail one exemplary embodiment of the toner concentration and volume sensors and liquid toner supply system of FIG. 1 for a four-color CMYK image output terminal.

In a three-color, i.e., CMY, or four-color, i.e., CMYK, liquid toner supply system 120, there will be three or four different toner supply subsystems in the liquid toner supply system 120, each subsystem providing one of the different single-color toners to the marking engine 110. In this case, there will be three, or as shown in FIG. 2, four, signal lines 202 and 204 and three, or as shown in FIG. 2, four, signal lines 206, respectively.

When the liquid toner supply system 120 is a custom-color toner supply system, such as a Pantone® toner supply system, the number of multi-component toner supply subsystems will depend upon the particular color system implemented in the liquid toner supply system 120. In this case, the number of signal lines 202, 204 and 206 will depend upon the particular implementation of the multi-component-toner liquid toner supply system 120.

It should also be appreciated that only a single signal control line 202, a single signal control line 204, and a single signal line 206 could be provided, by multiplexing each of the toner volume sensors 130, toner concentration sensors 140 and the toner supply devices of the liquid toner supply subsystem 120 onto the appropriate signal line 202, 204 or 206, respectively. Thus, while FIG. 1 shows one particular embodiment of the image output terminal 100, those of ordinary skill in the art will understand that many variations of the image output terminal 100 will be apparent and predictable from the above-outlined description of the image output terminal 100. Thus, specific descriptions of such modifications are unnecessary to put those of ordinary skill in the art in possession of such modified image output terminals, and thus are omitted.

It should also be appreciated that any other known or later developed toner concentration sensor could be used in place of the toner concentration sensors 140 that form part of the liquid toner supply system 120. Moreover, these alternate toner concentration sensors do not need to be part of the liquid toner supply system 120. Thus, the toner concentration sensor could be part of the marking engine 110. Similarly, the toner volume sensor can be any known or later developed device or system for sensing the toner volume.

The marking engine 110 can be any known or later developed type of marking engine, such as a raster output scanner-type marking engine, a full width print bar-type marking engine, a light-lens-type marking engine or the like. Moreover, the marking engine 110 can be a "write black" or a "write white" system, and can independently be a single-pass, single-transfer type marking engine or a multi-pass, single-transfer marking engine, such as those described in U.S. Pat. No. 5,655,192 to Denton et al., herein incorporated by reference in its entirety, or any other known or later developed marking engine, so long as the marking engine is a liquid-toner-type marking engine.

In any such liquid-toner-type marking engine, at least two types of control voltages are used: the surface voltage $V_S$ of the surface to be toned prior to creating the latent electrostatic image, and the development electrode voltage $V_D$ applied to the development electrode that applies the liquid toner to develop the latent electrostatic image on the surface to be toned. It will be recognized by those skilled in the art that the surface to be toned can be a dielectric member or a photoconductor and that the development electrode can be a roll turning the same direction as the surface to be toned, a roll turning in the opposite direction to the surface to be turned, or a fixed electrode over which the surface to be toned passes. The critical factor in developing a liquid toner image is the voltage differential ΔV between the surface voltage $V_S$ and the development electrode voltage $V_D$. In most image output terminals 100, the voltage differential ΔV is controlled by appropriately setting the surface voltage $V_S$ and the development voltage $V_D$ using the control and data signal lines 208.

FIG. 2 shows in greater detail one exemplary embodiment of the toner volume sensors 130, the toner concentration sensors 140 and the liquid toner supply system 120 for a CMYK liquid toner supply system 120. As shown in FIG. 2, the CMYK liquid toner supply system 120 includes a cyan liquid toner supply tank 122, a magenta liquid toner supply tank 124, a yellow liquid toner supply tank 126 and a black liquid toner supply tank 128. Connected to the cyan, magenta, yellow and black liquid toner supply tanks 122, 124, 126 and 128 are a cyan toner supply 123, a magenta toner supply 125, a yellow toner supply 127 and a black toner supply 129, respectively. Each of the cyan, magenta, yellow and black toner supplies 123, 125, 127 and 129 supplies the appropriately-colored toner particles to the respective liquid toner supply tanks 122, 124, 126 and 128 in response to toner supply signals transmitted over one of the control lines 206 from the IOT control system 200.

Also connected to each of the cyan, magenta, yellow and black liquid toner supply tanks 122, 124, 126 and 128 is a liquid carrier material supply device 121. Based on control signal supplied to the liquid carrier material supply device 121 over one or more of the signal lines 206, liquid carrier material is supplied to the various liquid toner supply tanks 122, 124, 126 and 128. In particular, by properly supplying either or both of the liquid carrier material and the appropriate toner particles to each of the liquid toner supply tanks 122, 124, 126 and 128, the toner particle concentration and the volume of liquid toner in each tank can be precisely controlled.

Also connected to the cyan liquid toner supply tank 122 are a cyan toner volume sensor 132 and a cyan toner concentration sensor 142. Similarly, a magenta toner volume sensor 134 and a magenta toner concentration sensor 144 are connected to the magenta liquid toner supply tank 124, a yellow toner volume sensor 136 and a yellow toner concentration sensor 146 are connected to the yellow liquid toner supply tank 126, and a black toner volume sensor 138 and a black toner concentration sensor 148 are connected to the black liquid toner supply tank 128. Each of the cyan, magenta, yellow and black toner volume sensors 132–138 senses the volume level of the respective liquid toner in the respective liquid toner supply tank 122, 124, 126 and 128. Similarly, each of the cyan, magenta, yellow and black toner concentration sensors 142–148 senses the toner particle concentration in the respective liquid toner supply tank 122, 124, 126 and 128.

The cyan, magenta, yellow and black toner volume sensors 132–138 output signals representative of the sensed volume level in the respective ones of the liquid toner supply tanks 122, 124, 126 and 128 over the one or more signal lines 202. Similarly, the cyan, magenta, yellow and black toner concentration sensors 142–148 output signals representative of the sensed toner concentration in the respective ones of the liquid toner supply tanks 122, 124, 126 and 128 over the one or more signal lines 204. It should be appreciated that the toner concentration sensors 140 could further comprise a multiplexer that permits only a single signal line 204 to be used. Similarly, the toner volume sensors 130 could further comprise a multiplexer that permits only one of the signal lines 202 to be used.

Figure 3:
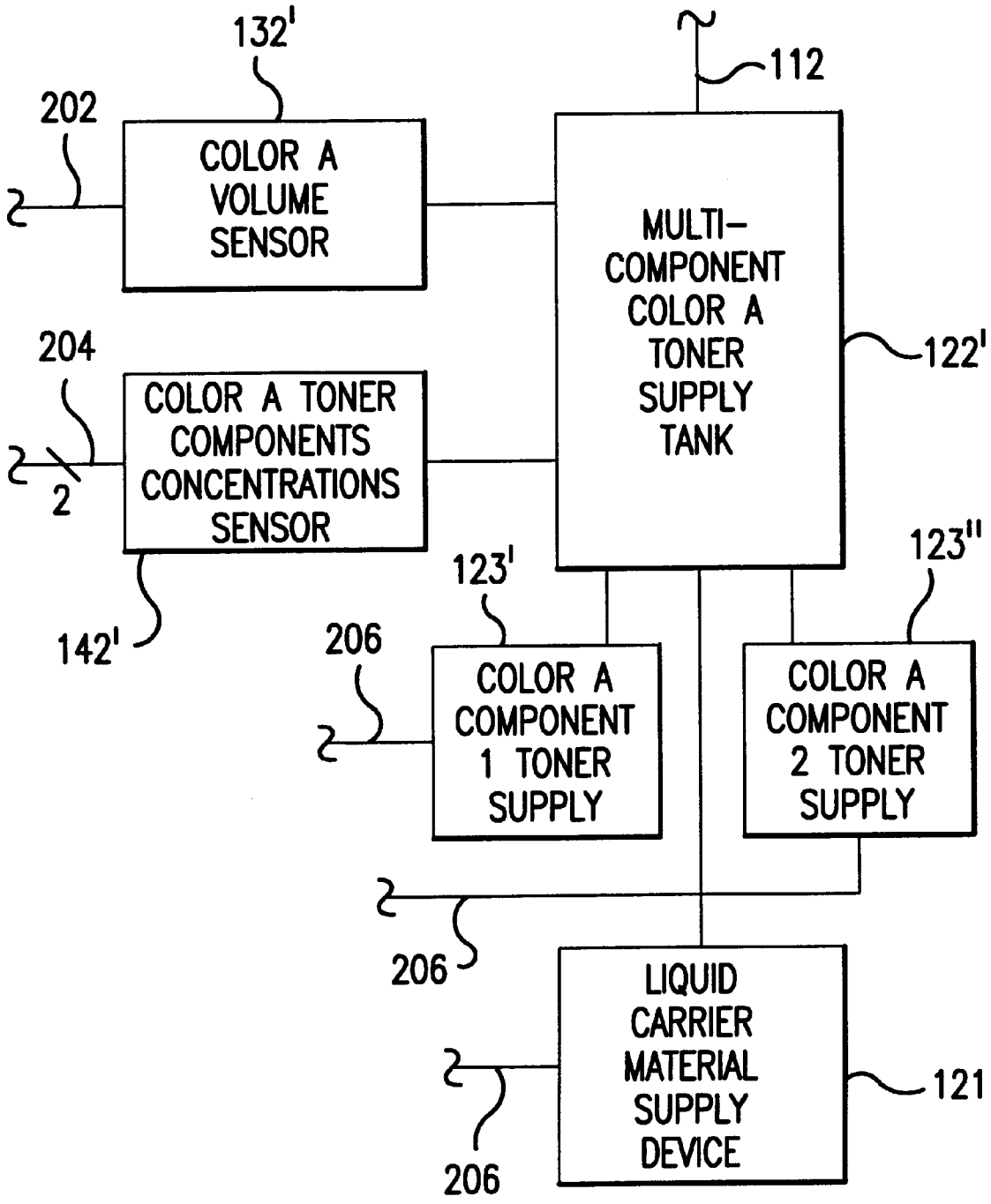
FIG. 3 shows an exemplary portion of the toner concentration and volume sensors and liquid toner supply system for a multi-component toner system according to this invention.

FIG. 3 shows one set of volume and concentration sensors, toner supply tank, toner component supply devices and a liquid carrier material supply device for a Pantone® or other custom-color liquid toner supply system 120, as described above. In particular, in a custom-color liquid toner supply system 120, such as a Pantone® liquid toner supply system, the number of multi-component colors to be supplied to the marking engine will depend upon the particular implementation. Thus, the following description will outline one such multi-component color toner supply tank and the sensors and other devices associated with it. Depending on the particular implementation, this structure may be duplicated for each different multi-component toner. Alternately, one or more of the toner component supply devices may each be connected to two or more of the multi-component toner supply tanks.

As shown in FIG. 3, a multi-component color A toner supply tank 122' supplies a multi-component toner to the marking engine 110 over one of the liquid toner supply conduits 112. Two component supply devices, a color A first component toner supply device 123' and a color A second component toner supply device 123", supply the first toner component toner particles and the second toner component toner particles to the multi-component color A toner supply tank 122' in response to control signals received over one or more of the control signal lines 206. Similarly, the liquid carrier material supply device 121 supplies liquid carrier material to the multi-component color A toner supply tank 122' in response to control signals received over one of the control signal lines 206.

A color A volume sensor 132' senses a level of the multi-component color A liquid toner in the multi-component color A toner supply tank 122'. Similarly, a color A toner components concentrations sensor 142' senses toner concentrations for each of the components, the first toner component and the second toner component, used to create the multi-component color A liquid toner stored in the multi-component color A toner supply tank 122'. The color A toner components concentrations sensor 142' outputs two signals over one or more of the signal lines 204 representing the toner concentration for each of the components, the first toner component and the second toner component, in the multi-component color A toner supply tank 122'. These signals are output over one or more of the signal lines 204 to the IOT control system 200. It will be recognized that these methods can easily be extended to cases where the color A toner has three or more components.

Figure 4:
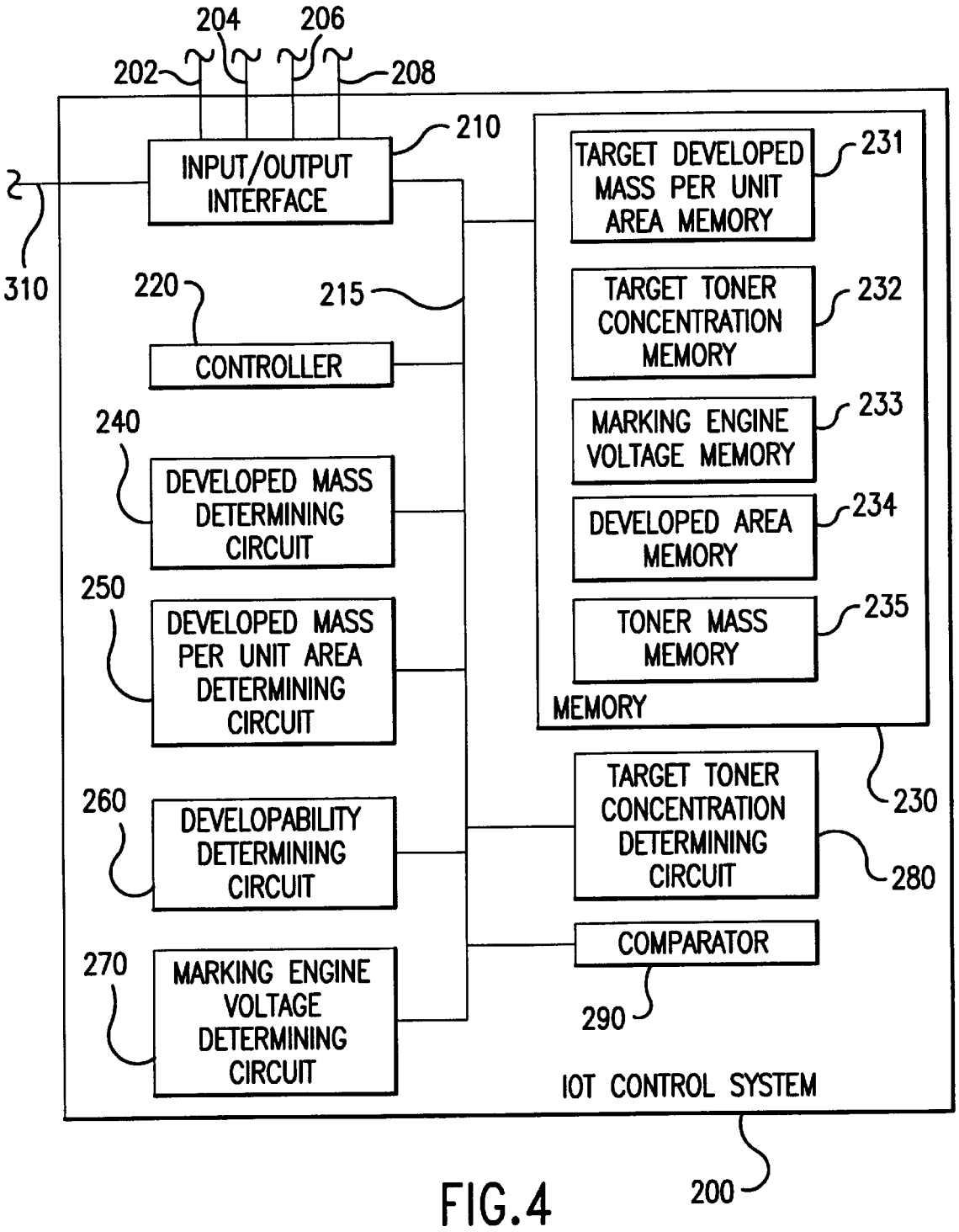
FIG. 4 shows in greater detail one exemplary embodiment of the IOT control system 200 of FIG. 1.

FIG. 4 shows in greater detail one exemplary embodiment of the IOT control system 200. As shown in FIG. 4 the signal line 310 from the image data source 300 and the one or more signal lines 202 and 204 from the toner volume sensors 130 and the toner concentration sensors 140 are connected to an input/output interface 210. At the same time, the input/output interface 210 outputs the control and data signals to the liquid toner supply system 120 and the marking engine 110 over the signal lines 206 and 208. The IOT control system 200 further includes a controller 220 that is connected by a signal and data bus 215 to the input/output interface 210, a memory 230, a developed mass determining circuit 240, a developed mass per unit area determining circuit 250, a developability determining circuit 260, a marking engine voltage determining circuit 270, a target toner concentration determining circuit 280 and a comparator 290.

As shown in FIG. 4, the memory 230 includes a target developed mass per unit area memory portion 231, a target toner concentration memory portion 232, a marking engine voltage memory portion 233, a developed area memory portion 234 and a toner mass memory portion 235. The memory 230 also stores the image data received from the image data source 300 over the signal line 310 until it is output to the marking engine 110 over the control and data lines 208. The memory 230 shown in FIG. 4 is preferably implemented using static or dynamic RAM. However, the memory 230 can also be implemented using a floppy disk and disk drive, a writeable optical disk and disk drive, a hard drive, flash memory, or any combination of these elements. The memory 230 can also be used to store control programs and any other data required by the IOT control system 200 or the image output terminal 100. The memory 230 can also be implemented using any other known or later developed volatile or non-volatile memory.

In some implementations, the IOT control system 200 will receive images from the image data source 300 in the form of bitmapped image data, i.e., on/off signals for the marking engine 110. In these implementations, the IOT control system 200 will deliver these on/off signals to the marking engine 110 along with signals to control the surface and development electrode voltages $V_S$ and $V_D$, and other aspects of the marking engine. In other implementations, the IOT control system 200 will receive image data that is in a higher level, descriptive form, such as a page description language, such as PostScript®. In these implementations, the IOT control system 200 will convert the received image data into on/off signals for the marking engine 110 and deliver these on/off signals to the marking engine 110, along with signals to control the surface and development electrode voltages $V_S$ and $V_D$, and other aspects of the marking engine.

In operation, the IOT control system 200 receives image data to be printed from the image data source 300 over the signal line 310 and outputs control and data signals to the marking engine 110 over the signal lines 208. In response, the marking engine 110 draws out liquid toner of various colors from the liquid toner supply system 120 through the conduits 112. During operation, the IOT control system 200 will intermittently monitor the liquid toner supply system 120 using the toner concentration sensors 140 and the toner volume sensors 130 to maintain the toner concentration in each of the different liquid toner supply tanks 122–128 in the liquid toner supply system 120 at desired levels. The IOT control system 200 will also adjust the voltage differential $\Delta V$ between the surface voltage $V_S$ and the development electrode voltage $V_D$ to detect and correct for any changes in the liquid xerographic toner developability of each of the liquid toners. In general, the IOT control system 200 will perform such sensing and control during non-printing gaps between different pages of a multi-page set of image data received from the image data source 300, during non-printing gaps that occur between sets of image data received from the image data source 300, or during idle periods when the image output terminal 100 has no pending image data sets to be printed.

The following discussion assumes the toner concentrations of each of the cyan, magenta, yellow and black liquid toner supply tanks of a CMYK liquid toner supply system have been adjusted to the corresponding target toner concentration levels and that no image data has been received and printed by the image output terminal since the toner concentration levels were adjusted. Thus, the developed area values for each of the different toners stored in the developed area memory have been reset to 0.

The image data source 300 then begins sending image data over the signal line 310 to the image output terminal 100. The image output terminal control system 200 inputs the image data and stores the received image data in the memory 230 for printing. Depending upon the features of the image output terminal 100, the IOT control system 200 may decompose the image data into cyan, magenta, yellow and black color separation layers, or the data may be received from the image data source already in the cyan, magenta, yellow and black color separation layers. In either case, as the controller 220 outputs data to the marking engine 110 over one or more of the data and signal lines 208 for each of the color separation layers, the controller 220 sums, for each of the color separation layers, the foreground area and adds it to the appropriate value stored in the developed area memory portion 234 of the memory 230. Thus, the developed area memory 234 maintains a running total of the foreground areas for each of the color separation layers printed by the marking engine 110.

In one exemplary embodiment of the image output terminal control system 200, the controller 220 determines the foreground areas of the color separation layers using the pixel counting methods disclosed in U.S. patent application Ser. No. 08/551,381, which is incorporated herein by reference in its entirety. However, it should be appreciated that any known or later developed method for determining the developed area from the image data can be used to generate the running total stored in the developed area memory 234.

Eventually, after one or more pages, or after a portion of a page, of the image data has been output to and printed by the marking engine 110, the controller 220 determines whether it is appropriate to check on the status of one or more of the liquid toner supply tanks 122–128 of the liquid toner supply system 120. Various different methods can be used to indicate the appropriateness of checking the status of the liquid toner supply tanks 122–128. For example, checking the status of the liquid toner supply tanks 122–128 can be based on the total number of pages printed since the last check, the developed area of one or more of the color separation layers stored in the developed area memory 234 exceeding one or more predetermined thresholds, a time interval since the last check, a temperature or humidity value change exceeding one or more thresholds, or the like. In general, any known or later developed method can be used, and the systems and methods of this invention are independent of any such method.

Once the controller 220 has determined that it is appropriate to check one or more of the liquid toner supply tanks 122–128, and which one or more liquid toner supply tanks 122–128 to check, the controller 220 inputs, for each such liquid toner supply tank 122–128, a toner concentration signal and a toner volume signal from the corresponding toner concentration sensor 140 and the corresponding toner volume sensor 130, respectively. The sensed toner concentration and the sensed toner volume are then input to the developed mass determining circuit 240, which determines the current mass of toner present in the corresponding liquid toner supply tank. The developed mass determining circuit 240 then inputs a previous toner mass value from the toner mass memory portion 235. This previous toner mass value indicates the toner mass that was present in the appropriate liquid toner supply tank after the status of that toner supply tank was last adjusted by adding toner and/or liquid carrier material to that liquid toner supply tank.

The developed mass determining circuit 240 then subtracts the just-determined toner mass for the appropriate liquid toner supply tank from the previous toner mass for that supply tank to determine the change in toner mass ΔM in that liquid toner supply tank since that tank was last adjusted. This change in mass ΔM is assumed to correspond to the toner mass that was transferred from the corresponding liquid toner supply tank to the marking engine and onto the printed pages. Then, the change in mass ΔM determined by the developed mass determining circuit 240 is output to the developed mass per unit area determining circuit 250.

The developed mass per unit area determining circuit 250 also inputs the developed area value ΔA from the developed area memory portion 234 for the appropriate liquid toner supply tank. The developed mass per unit area determining circuit 250 then divides the change in mass value ΔM output by the developed mass determining circuit 240 by the developed area value ΔA output from the developed area memory portion 234 to determine a developed mass per unit area (DMA or $M_D$) value for the particular toner, and outputs it to the developability determining circuit 260.

The developability determining circuit 260 then either reads the voltage differential ΔV directly from the marking engine voltage memory portion 233 or determines the voltage differential by reading the surface voltage $V_S$ and the development electrode voltage $V_D$ from the marking engine voltage memory portion 233. The developability determining circuit 260 then multiplies the determined or read voltage differential ΔV for the current toner with the toner concentration value $T_C$ for that toner supplied from the toner concentration sensor 140 for that toner to obtain an intermediate value. The developability determining circuit 260 then divides the developed mass per unit area $M_D$ obtained from the developed mass per unit area determining circuit 250 for this toner by the intermediate value for this toner to determine the developability value D for this toner. The developability determining circuit 260 then outputs the determined developability value D for this toner to the marking engine voltage determining circuit 270.

The marking engine voltage determining circuit 270 multiplies the developability value D determined by the developability determining circuit 260 by the toner concentration value $T_C$ for this toner sensed by the appropriate toner concentration sensor 140 to generate a second intermediate value. The marking engine voltage determining circuit 270 then divides a target developed mass per unit area value $M_T$ stored in the target developed mass per unit area memory portion 231 by the second intermediate value to determine a new voltage differential ΔV for this toner. The marking engine voltage determining circuit 270 then determines whether the voltage differential ΔV is within a predetermined range of voltage differentials for this toner.

If the voltage differential is above a maximum voltage differential $\Delta V_{MAX}$ or below a minimum voltage differential $\Delta V_{MIN}$, a system error has occurred in the image output terminal and a system error signal is generated. Otherwise, if the voltage differential ΔV for this toner is within the voltage differential range, the marking engine voltage determining circuit 270 adjusts one or both of the surface voltage $V_S$ and/or the development electrode voltage $V_D$ to obtain the new voltage differential ΔV. The marking engine voltage determining circuit 270 then stores the new marking engine voltages $V_S$ and $V_D$ for the surface and the development electrode, and possibly the voltage differential ΔV itself, in the marking engine voltage memory portion 233.

In particular, the marking engine voltage determining circuit 270 reads a maximum voltage differential $\Delta V_{MAX}$ and a minimum voltage differential $\Delta V_{MIN}$ from the marking engine voltage memory portion 233 and outputs the minimum and maximum voltage differentials $\Delta V_{MAX}$ and $\Delta V_{MIN}$ and the just-determined voltage differential ΔV to the comparator 290. The comparator 290 compares the just-determined voltage differential ΔV to the maximum voltage differential $\Delta V_{MAX}$ and the minimum voltage differential $\Delta V_{MIN}$ and outputs the results to the marking engine voltage determining circuit 270.

As is well known to those skilled in the art of electrophotography, the surface voltage $V_S$ may actually be adjusted by a separate sequence of control operations, involving, for example, changing a corotron current and/or a scorotron grid voltage, or changing the current to light emitting diodes, or changing the control parameters to other writing mean such as a laser scanner or an array of ion sources, and the adjustment of the surface voltage $V_S$ may also include feedback from a sensor which measures the resulting surface voltage $V_S$.

The target toner concentration determining circuit 280 then inputs the determined developability value D from the developability determining circuit 260 and the target developed mass per unit area value $M_T$ from the target developed mass per unit area memory portion 233. The target toner concentration determining circuit 280 further inputs a target differential voltage $\Delta V_T$ for this toner from the marking engine voltage memory portion 233. The target toner concentration determining circuit 280 then multiplies the developability value D from the developability determining circuit 260 by the target differential voltage $\Delta V_T$ from the marking engine voltage memory portion 233 to obtain a third intermediate value. The target toner concentration determining circuit 280 then divides the target developed mass per unit area value $M_T$ from the target developed mass per unit area memory portion 233 by the third intermediate value to obtain a new target toner concentration value $T_T$ for this toner.

The comparator 290 then inputs the new target toner concentration value $T_T$ for this toner and the measured toner concentration $T_C$ for this toner. If the measured toner concentration value $T_C$ equals the target toner concentration value $T_T$, the comparator causes the target toner concentration value $T_T$ to be stored in the target toner concentration memory portion 233 and the controller determines if any further liquid toner supply tanks need to be analyzed at this time.

Otherwise, if the comparator 290 indicates that the target toner concentration value $T_T$ is greater than the sensed toner concentration value, the comparator 290 stores the target toner concentration value $T_T$ in the target toner concentration memory portion 232. The controller 220 then outputs a signal to the appropriate toner supply device 123–129 to add toner particles to the appropriate liquid toner supply tank 122–128. On the other hand, if the comparator 290 determines that the new target toner concentration value $T_T$ is less than the sensed toner concentration value $T_C$, the comparator 290 stores the new target toner concentration value $T_T$ in the target toner concentration memory portion 232. The controller 220 then provides an output signal to the liquid carrier material supply device 121 to add liquid carrier material to the appropriate one of the liquid toner supply tank 122–128 to reduce the toner concentration in that tank.

The volume of carrier material to be added to the liquid toner supply tank is added to the current volume of the liquid toner supply tank and the desired new volume is compared to a maximum for the liquid toner supply tank. If the desired new volume is greater than the maximum volume, then some of the liquid toner in the supply tank can be drained off by opening a valve to a supply drain.

The controller 220 then again determines whether any other liquid toner supply tanks 122–128 need to be analyzed at this time. If so, the next liquid toner supply tank 122–128 is selected for analysis. Otherwise, the controller 220 begins outputting image data through the marking engine 110 or waits for additional image data to be received from the image data source 300.

Figure 5:
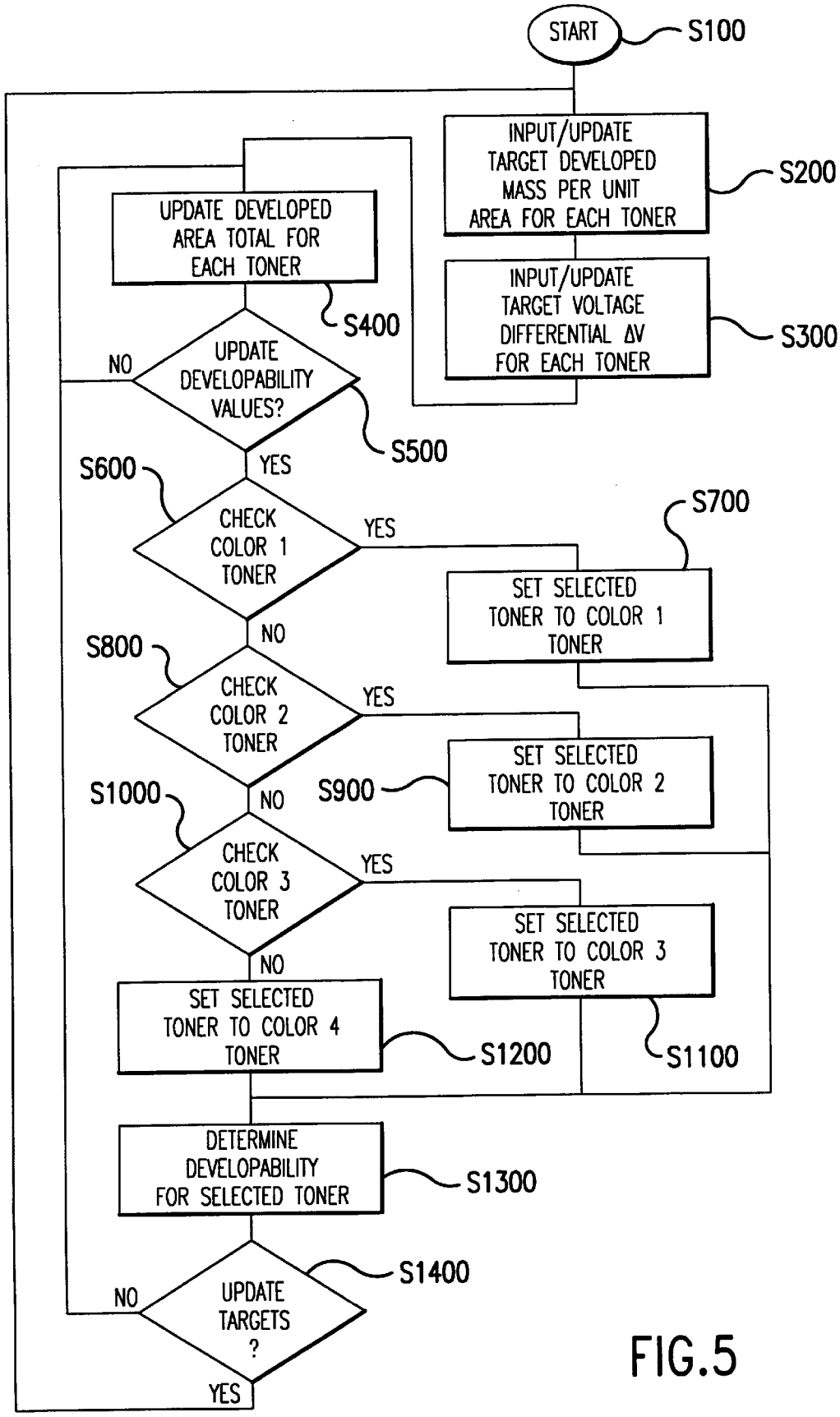
FIG. 5 is a flowchart outlining one exemplary embodiment of a method for compensating for changes in the developability of a liquid toner in an image output terminal according to this invention.

FIG. 5 is a flowchart outlining one exemplary embodiment of the methods for detecting and compensating for changes in liquid electrophoretic toner developability. Beginning in step S100, control continues to step S200, where the target developed mass per unit area, $M_{Tj}$, for each toner j is input or updated. Then, in step S300, the target voltage differential, $\Delta V_{Tj}$, for each toner j is input or updated. Next, in step S400, the developed area total, $\Delta A_j$, for each toner j is updated based on the foreground area within the color separation layer corresponding to each toner j for each page that has been output. Control then continues to step S500.

In step S500, as indicated above, one or more process values are checked to determine whether the developability values should be updated. If not, control returns from step S500 to step S400. Otherwise, if the developability value should be updated, control continues to step S600. In step S600, the process variables are checked to determine if a first color toner's developability should be checked. If so, control continues to step S700, where the selected toner is set to the first color toner. Control then jumps to step S1300. Otherwise, control continues to step S800.

In step S800, the process values are checked to determine if a second color toner's developability should be updated. If so, control continues to step S900. In step S900, the selected toner is set to the second color toner. Control then jumps to step S1300. Otherwise, control continues to step S1000.

In step S1000, the process values are checked to determine if a third color toner's developability should be updated. If so, control continues to step S1100. In step S1100, the selected toner is set to the third color toner. Otherwise, control continues to step S1200, where the selected toner is set to the fourth color toner. Control then continues to step S1300.

It should be appreciated that the above outlined description of steps S600–S1200 assumes a four-color liquid toner system. If the liquid toner system has less than four colors, one or more of steps S600–S1200 would be omitted. For example, for a three-color liquid toner system, control would jump directly from step S800 to step S1200. For a monochrome liquid toner system, control would jump directly from step S500 to step S1300. Similarly, for liquid toner systems that use more than four colors, additional steps corresponding to steps S600 and S700 or steps S800 and S900 would be inserted between steps S1000 and S1200.

It should also be appreciated that the color first-fourth toners can be single component toners, such as cyan, magenta, yellow or black toners. The first-fourth toners can also be multiple-component custom-color toners, such as Pantone® toners, as described above.

In step S1300, the developability for the selected toner is determined. Then, in step S1400, the system is checked to determine if the target developed mass per unit area $M_T$ and/or the target voltage differential $\Delta V_T$ for any one of the toners needs to be updated for any reason. If so, control jumps back to S200. Otherwise, control jumps back to step S400.

It should also be appreciated that, if the target developed mass per unit area $M_T$ for each toner and the target voltage differential $\Delta V_T$ for each toner are fixed, control would jump directly from step S100 to step S400 and control would return directly from step S1300 to step S400. That is, in this case, steps S200, S300 and S1400 would be omitted.

Figure 6:
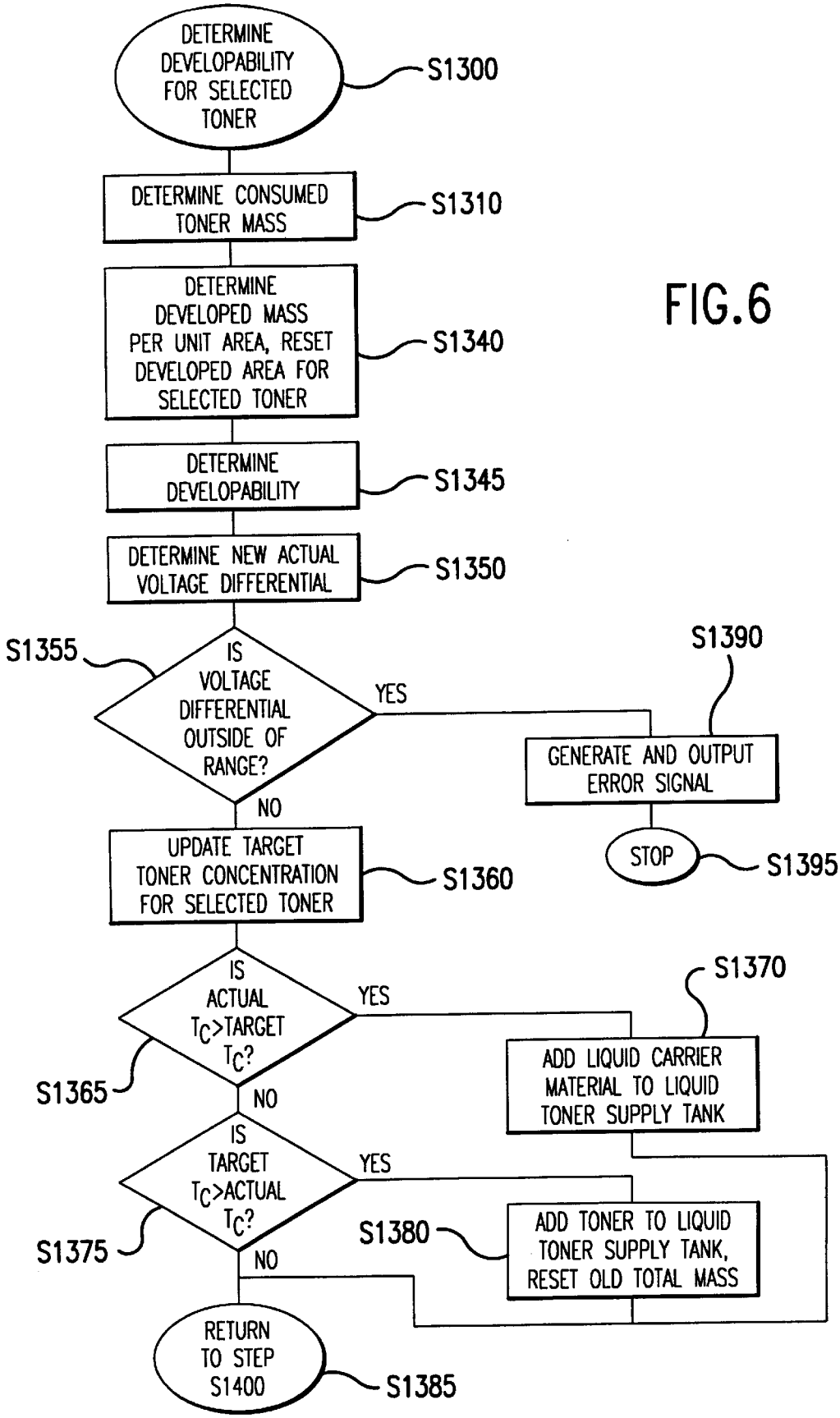
FIG. 6 is a flowchart outlining in greater detail one exemplary embodiment of the developability determining step of FIG. 5 according to this invention.

The flowchart of FIG. 6 outlines in greater detail one exemplary embodiment of the developability determining step of step S1300 of FIG. 5. Beginning in step S1300, control continues to step S1310, where the consumed toner mass $\Delta M$ is determined. The consumed toner mass $\Delta M$ is the mass of toner consumed since the last time the developability was determined for this particular selected toner. In particular, the consumed toner mass $\Delta M_j$, for the selected toner j is:

$$\Delta M_j = M_{jo} - M_{jn}, \tag{1}$$

where:

$M_{jo}$ is the previous value for the toner mass in the liquid toner supply tank for the toner j; and $M_{jn}$ is the new value for the mass of toner in the liquid toner supply tank for the toner j.

Then, in step S1340, the developed mass per unit area $M_D$ is determined and the developed area $\Delta A$ for the selected toner j is reset. In particular, the determined mass per unit area $M_{Dj}$ for the selected toner j is:

$$M_{Dj} = \Delta M_j / \Delta A_j, \tag{2}$$

where $\Delta A_j$ is the total foreground area for the color separation layer corresponding to the toner j since the last time the developability was determined for the selected toner j.

Then, in step S1345, the developability D for the selected toner j is determined. In particular, the developability $D_j$ is:

$$D_j = M_{Dj} / (T_{Cj} \cdot \Delta V_j), \tag{3}$$

where:

$T_{Cj}$ is a sensed toner concentration for the selected toner j; and $\Delta V_j$ is the differential voltage for the selected toner j.

Next, in step S1350, a new actual voltage differential $\Delta V_N$ for the selected toner j is determined. In particular, the new actual voltage differential $\Delta V_{Nj}$ for the selected toner j is:

$$\Delta V_{Nj} = M_{Tj} / (T_{Cj} \cdot D_j), \tag{4}$$

where $M_T$ is the target developed mass per unit area for the selected toner j. Control then continues to step S1355.

In step S1355, the voltage differential $\Delta V$ is checked to determine if it is outside of a determined range of allowable voltage differentials. If the voltage differential $\Delta V_j$ for the selected toner j is greater than a maximum allowable voltage differential $\Delta V_{jmax}$ for the selected toner j or is less than a minimum voltage differential $\Delta V_{jmin}$ for the selected toner j, control jumps to step S1390. Otherwise, if the voltage differential $\Delta V_N$ is between the minimum and maximum voltage differentials $\Delta V_{jmin}$ and $\Delta V_{jmax}$ for the selected toner j, control continues to step S1360.

In step S1360, the target toner concentration $T_{Tj}$ for the selected toner j is updated. In particular, the target toner concentration for the selected toner $T_{Tj}$ for the selected toner j is:

$$T_{Tj} = M_{Tj} / (D_j \cdot \Delta V_{Tj}) \tag{5}$$

where $\Delta V_{Tj}$ is a target voltage differential for the selected toner.

Next, in step S1360, the sensed toner concentration $T_{Cj}$ is checked to determine if it is greater than the target toner concentration $T_{Tj}$ for the selected toner j. If the sensed toner concentration $T_{Cj}$ for the selected toner j is greater than the target toner concentration $T_{Tj}$ for the selected toner j, control continues to step S1370. Otherwise, control jumps to step S1375. In step S1370, liquid carrier material is added to the liquid toner supply tank for the selected toner to lower the toner concentration for the selected toner to the target toner concentration for the selected toner. Control then jumps to step S1385.

In step S1375, the sensed toner concentration $T_{Cj}$ is checked to determine if it less than the target toner concentration $T_{Tj}$ for the selected toner. If so, control continues to step S1380. Otherwise, control jumps to step S1385. In step S1380, the selected toner j is added to the liquid toner supply tank corresponding to the selected toner to raise the sensed toner concentration to the target toner concentration. At the same time, the old total mass, which indicates the total mass in the liquid toner supply tank for the selected toner at the end of the developability determining process, is reset to reflect that toner has been added to the liquid toner supply tank for the selected toner. Control then continues to step S1385.

In step S1385, control is returned to step S1400 in FIG. 5.

Figure 7:
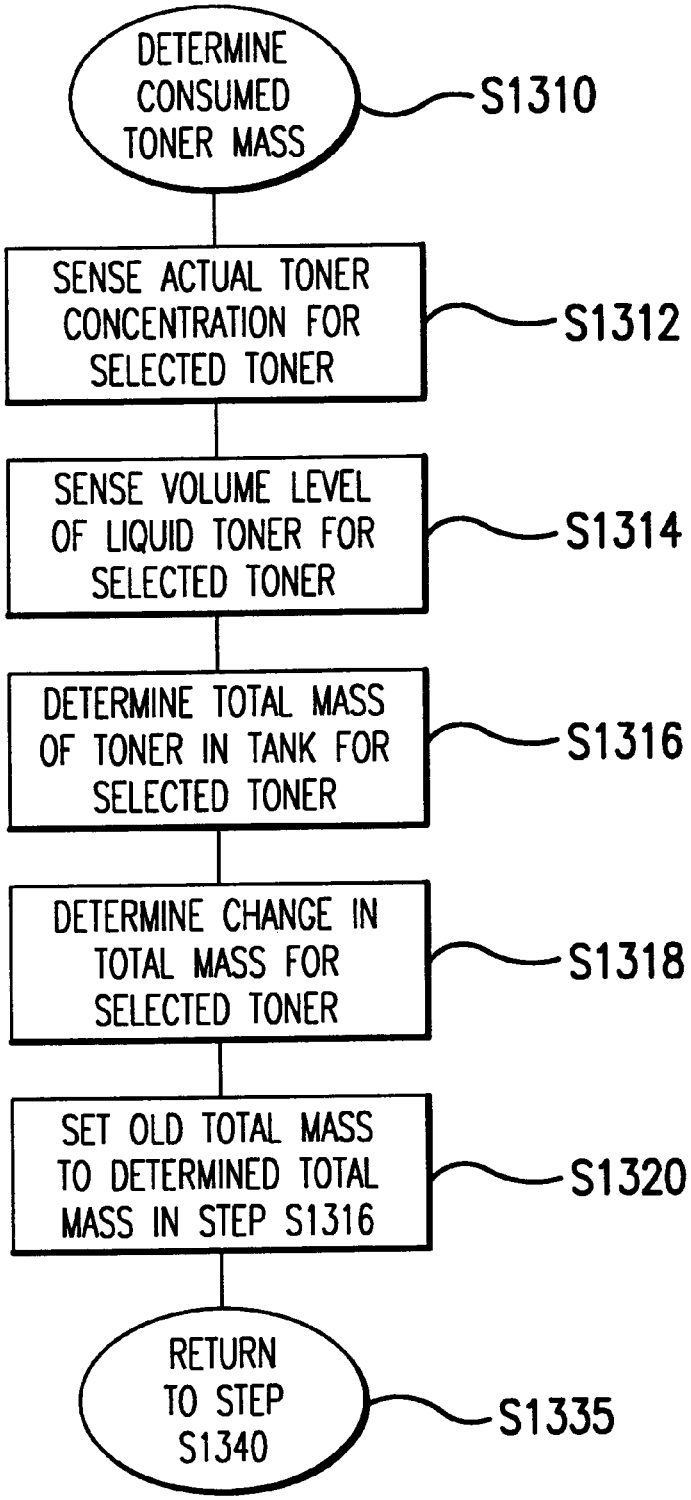
FIG. 7 is a flowchart outlining in greater detail one exemplary embodiment of the consumed toner mass determining step of FIG. 6 for a single component toner.

The flowchart of FIG. 7 outlines in greater detail one exemplary embodiment of the consumed toner mass determination of step S1310 of FIG. 6 for a single-component toner. Beginning in step S1310, control continues to step S1312, where the toner concentration $T_{Cj}$ for the selected toner j is sensed. Then, in step S1314, the volume level of the liquid toner in the liquid toner supply tank for the selected toner j is sensed. Next, in step S1316, the total mass $M_{jn}$ of toner presently in the liquid toner supply tank for the selected toner is determined. In particular, the present, or new, total mass $M_n$ is:

$$M_{nj}=T_{Cj}\cdot v_j \tag{6}$$

where $v_j$ is the sensed volume level of the liquid toner in the liquid toner supply tank for the selected toner j. Control then continues to step S1318.

In step S1318, the change in total mass $\Delta M_j$ for the selected toner j is determined according to Eq. 1 set forth above. Next, in step S1320, the old total mass $M_{jo}$ for the selected toner is set to the determined total mass $M_{jn}$ determined in step S1316. Next, in step S1335, control returns to step S1340.

Figure 8:
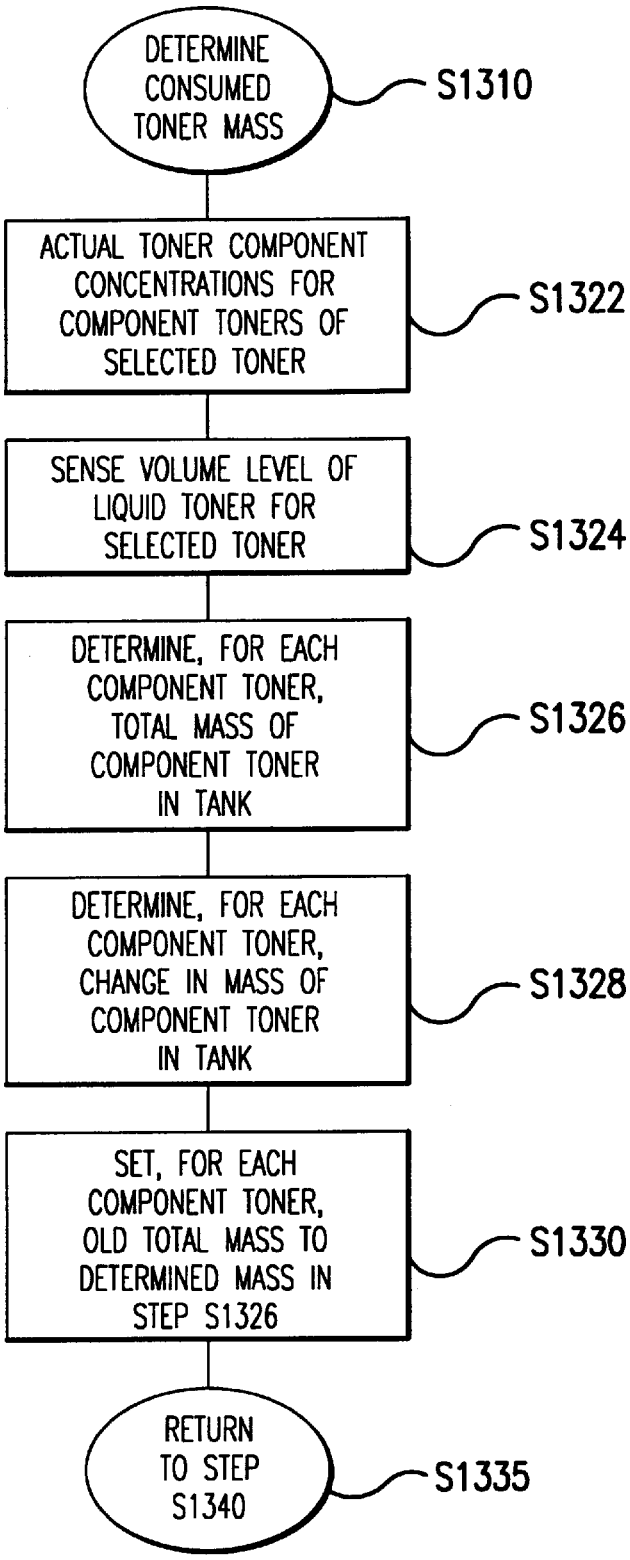
FIG. 8 is a flowchart outlining in greater detail one embodiment of the consumed toner mass determining step of FIG. 6 for a multi-component toner system.

The flowchart of FIG. 8 outlines in greater detail one exemplary embodiment of the consumed toner mass determination of step S1310 for a multi-component toner. Beginning in step S1310, control continues to step S1322. In step S1322, the toner component concentrations $T_{Cji}$ for each of the component toners i that form the selected toner j are sensed or are otherwise determined. In particular, any known or later developed method for individually sensing the concentrations of the component toners i or for determining the concentrations of the component toners i based on measurements of the selected toner j can be used to obtain the sensed toner component concentrations $T_{Cji}$ for the component toners i of the selected toner j. Then, in step S1324, the volume level $v_j$ of the liquid toner in the liquid toner supply tank for the selected toner j is sensed. Next, in step S1326, for each component toner i, the total mass $M_{nji}$ of that component toner i in the liquid toner supply tank for the selected toner j is determined according to Eq. 6 set forth above. Control then continues to step S1328.

In step S1328, for each component toner i, the change in mass $\Delta M_{ji}$ of that component toner in the liquid toner supply tank for the selected toner is determined according to Eq. 1 set forth above. Then, in step S1330, for each component toner, the old total mass $M_{oji}$ for that component i is set to the determined mass $M_{nji}$ for that component i determined in step S1326. Then, in step S1335, control again returns to step S1340.

As shown in FIGS. 1 and 4, the IOT control system 200 and controller 220 are preferably implemented using a programmed general purpose computer. However, the IOT control system 200 and/or the controller 220 can also be implemented using a special purpose computer, a programmed microprocessor or microcontroller and peripheral integrated circuit elements, an ASIC or other integrated circuit, a digital signal processor, a hardwired electronic or logic circuit such as a discrete element circuit, a programmable logic device such as a PLD, PLA, FPGA or PAL, or the like. In general, any device, capable of implementing a finite state machine that is in turn capable of implementing the flowcharts shown in FIGS. 5–8, can be used to implement the IOT control system 200 and/or the controller 220.

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of this invention.

What is claimed is:

1. A method for determining, in a liquid toner development image forming device, a developability of a toner, the toner comprising toner particles suspended in a liquid carrier material, comprising:

determining a current toner concentration of the toner particles in the liquid carrier material for the toner;

determining a printing interval;

determining a developed area value for the toner for the printing interval;

determining a consumed mass value for the toner for the printing interval;

determining a developed mass per unit area value for the toner based on the developed area and consumed mass values;

determining the developability of the toner based on the determined developed mass per unit area, the determined current toner concentration and a voltage differential within the liquid toner development image forming device for the toner.

2. The method of claim 1, wherein determining the developed area for the toner for the printing interval comprises:

determining an initial value for the developed area for the toner at a start of the printing interval;

determining, for a portion of image data developed during the printing interval, an amount of area of that portion to be developed with the toner;

adding the amount of developed area for that portion to the initial value to obtain a final value for the developed area for the toner at the end of the printing interval; and determining the developed area based on the initial and final values for the developed area for the toner.

3. The method of claim 2, wherein the initial value is reset to zero at the start of the printing interval.

4. The method of claim 1, wherein determining the consumed toner mass for the printing interval comprises:

determining an initial value of a toner mass in a toner supply device for the toner at the start of the printing interval;

determining a volume of the liquid toner in the toner supply device for the toner at the end of the printing interval;

determining a final value of the toner mass in the toner supply device at the end of the printing interval based on the determined volume and the determined current toner concentration; and determining the consumed mass based on the initial and final values for the toner mass for the toner.

5. The method of claim 4, wherein the initial value of the toner mass for a next printing interval is set to the final value of the toner mass for a previous printing interval.

6. The method of claim 1, wherein the voltage differential for the toner is determined based on a surface voltage to be applied to a surface to be developed and a development electrode voltage to be applied to a development electrode that applies the toner to the surface to be developed.

7. The method of claim 1, further comprising determining a new voltage differential within the liquid toner development image forming device based on the determined current toner concentration, the determined developability and a target developed mass per unit area for the toner.

8. The method of claim 7, wherein the new voltage differential within the liquid toner development image forming device is provided by adjusting at least one of a surface voltage to be applied to a surface to be developed and a development electrode voltage to be applied to a development electrode that applies the toner.

9. The method of claim 1, further comprising determining a target toner concentration for the toner based on the determined developability, a target voltage differential and a target developed mass per unit area.

10. The method of claim 9, further comprising:

comparing the determined target toner concentration to the determined current toner concentration for the toner;

adding toner particles to the liquid carrier material when the determined target toner concentration is greater than the determined current toner concentration; and adding additional liquid carrier material to the liquid carrier material of the toner when the determined current toner concentration is greater than the determined target toner concentration.

11. The method of claim 1, wherein, when the liquid toner development image forming device includes a plurality of different toners, the developability determining method is performed for each different toner.

12. The method of claim 11, wherein the developability determining method is performed for each different toner over a single printing interval.

13. The method of claim 11, wherein the developability determining method is performed over a separate printing interval for each different toner.

14. The method of claim 1, wherein, when the toner comprises a plurality of separate toner components, the developability determining method is performed for each separate toner component.

15. The method of claim 14, wherein determining the developed area value for the toner for the printing interval comprises, for each of the plurality of toner components:

determining an initial value for the developed area for that toner component at a start of the printing interval;

determining, for a portion of image data developed during the printing interval, an amount of area of that portion to be developed with that toner component;

adding the amount of developed area for that toner component within that portion to the initial value for that toner component to obtain a final value for the developed area for that toner component at the end of the printing interval; and determining the developed area of that toner component based on the initial and final values for the developed area for that toner component.

16. The method of claim 15, wherein, for each toner component, the initial value of the developed area for that toner component is reset to zero at the start of the printing interval.

17. The method of claim 14, wherein, for each of the plurality of toner components, determining the current toner concentration of the toner particles in the liquid carrier material for the toner comprises determining a current toner component concentration for that toner component.

18. The method of claim 17, wherein, for each of the plurality of toner components, determining the consumed toner mass for the printing interval comprises:

determining an initial value of a toner mass for that toner component in a toner supply device for the toner at the start of the printing interval;

determining a volume of the liquid toner in the toner supply device for the toner at the end of the printing interval;

determining a final value of the toner mass for that toner component at the end of the printing interval based on the determined volume of the liquid toner and the determined current toner component concentration of that toner component in the toner supply device for the toner; and determining the consumed mass of that toner component based on the initial and final values for the toner mass for that toner component.

19. The method of claim 18, wherein, for each of the plurality of toner components, the initial value of the toner component mass for that toner component for a next printing interval is set to the final value of the toner component mass for that toner component of a previous printing interval.

20. The method of claim 17, further comprising, for each of the plurality of toner components, determining a target toner concentration for that toner component based on the determined developability of that toner component, a target voltage differential and a target developed mass per unit area of that toner component.

21. The method of claim 20, further comprising for each of the plurality of toner components:

comparing the determined target toner concentration for that toner component to the determined current toner component concentration for that toner component;

adding toner particles of that toner component to the liquid carrier material when the determined target toner component concentration is greater than the determined current toner component concentration; and adding additional liquid carrier material to the liquid carrier material for that toner component when the determined current toner component concentration is greater than the determined target toner component concentration.

22. The method of claim 17, wherein at least two of the plurality of toner components are stored in a multi-component toner supply device.

23. An apparatus that determines, for a liquid toner development image forming device, a developability of a toner, the toner comprising toner particles suspended in a liquid carrier material, comprising:

a memory;

a toner concentration sensor that senses a concentration of toner in a toner supply device;

a developed area value determining circuit;

a consumed mass value determining circuit;

a developed mass per unit area value determining circuit; and a developability determining circuit.

24. The apparatus of claim 23, wherein the developed area value determining circuit comprises:

an initial developed area value determining circuit that stores an initial developed area value in the memory; and an adding circuit that, for a portion of image data developed during the printing interval, adds an amount of area of that portion to be developed with the toner to the initial developed area value stored in the memory.

25. The apparatus of claim 24, wherein the initial developed area value determining circuit resets the initial developed area value to zero at a beginning of a printing interval.

26. The apparatus of claim 23, further comprising a liquid toner volume sensor that senses a volume of the liquid toner in the toner supply device, wherein:

the memory stores an initial toner mass value; and the consumed toner mass determining circuit comprises:

a toner mass determining circuit that determines a toner mass based on the sensed liquid toner volume and the sensed toner concentration, and a consumed toner mass determining circuit that determines a consumed toner mass based on the determined toner mass and the initial toner mass value.

27. The apparatus of claim 26, wherein the consumed toner mass determining circuit further comprises a toner mass storing circuit that stores the determined toner mass as the initial toner mass value in the memory.

28. The apparatus of claim 23, further comprising a voltage determining circuit that determines a voltage differential for the liquid toner development image forming device based on the sensed toner concentration, the determined developability and a target developed mass per unit area for the toner.

29. The apparatus of claim 28, wherein the voltage determining circuit comprises a voltage adjusting circuit that adjusts at least one of a surface voltage to be applied to a surface to be developed by the toner and a development electrode voltage to be applied to a development electrode that applies the toner based on the determined voltage differential.

30. The apparatus of claim 23, further comprising a target toner concentration determining circuit that determines a target toner concentration for the toner based on the determined developability, a target voltage differential and a target developed mass per unit area.

31. The apparatus of claim 30, further comprising:

a comparator that compares the determined target toner concentration to the sensed toner concentration for the toner;

a toner particles adding device that adds toner particles to the liquid carrier material when the determined target toner concentration is greater than the determined toner concentration; and a liquid carrier material adding device that adds additional liquid carrier material to the liquid carrier material of the toner when the determined toner concentration is greater than the determined target toner concentration.

32. The apparatus of claim 23, wherein the liquid toner development image forming device is one of a digital copier, an analog copier, a laser printer, and a facsimile device.

33. A method for determining, in a liquid toner development image forming device, a developability of a toner, the toner comprising toner particles suspended in a liquid carrier material, comprising:

determining a current toner concentration of the toner particles in the liquid carrier material for the toner;

determining a developed area value for the toner;

determining a consumed mass value for the toner;

determining a developed mass per unit area value for the toner based on the developed area and consumed mass values;

determining the developability of the toner based on the determined developed mass per unit area, the determined current toner concentration and a voltage differential within the liquid toner development image forming device for the toner.

34. The method of claim 33, wherein the voltage differential for the toner is determined based on a surface voltage to be applied to a surface to be developed and a development electrode voltage to be applied to a development electrode that applies the toner to the surface to be developed.

35. The method of claim 33, further comprising determining a new voltage differential within the liquid toner development image forming device based on the determined current toner concentration, the determined developability and a target developed mass per unit area for the toner.

36. The method of claim 35, wherein the new voltage differential within the liquid toner development image forming device is provided by adjusting at least one of a surface voltage to be applied to a surface to be developed and a development electrode voltage to be applied to a development electrode that applies the toner.

37. The method of claim 33, further comprising determining a target toner concentration for the toner based on the determined developability, a target voltage differential and a target developed mass per unit area.

38. The method of claim 37, further comprising:

comparing the determined target toner concentration to the determined current toner concentration for the toner;

adding toner particles to the liquid carrier material when the determined target toner concentration is greater than the determined current toner concentration; and adding additional liquid carrier material to the liquid carrier material of the toner when the determined current toner concentration is greater than the determined target toner concentration.

39. The method of claim 33, wherein, when the liquid toner development image forming device includes a plurality of different toners, the developability determining method is performed for each different toner.

40. The method of claim 33, wherein, when the toner comprises a plurality of separate toner components, the developability determining method is performed for each separate toner component.

* * * * *